United States Patent [19]

Lattner

[11] Patent Number: 4,644,609

[45] Date of Patent: Feb. 24, 1987

[54] SPINNING MACHINE DRAFTING FRAME

[75] Inventor: Manfred Lattner, Ebersbach, Fed. Rep. of Germany

[73] Assignee: Zinser Textilmaschinen GmbH, Ebersbach/Fils, Fed. Rep. of Germany

[21] Appl. No.: 697,733

[22] Filed: Feb. 4, 1985

[30] Foreign Application Priority Data

Feb. 8, 1984 [DE] Fed. Rep. of Germany ..... 3404291

[51] Int. Cl.[4] ..... D01H 5/86

[52] U.S. Cl. ..... 19/244; 19/256; 19/288; 57/87

[58] Field of Search ..... 19/244, 245, 246, 256, 19/288, 0.25; 57/87

[56] References Cited

U.S. PATENT DOCUMENTS

| | | | |
|---|---|---|---|
| 2,953,822 | 9/1960 | Schiltknecht | 19/256 X |
| 3,604,195 | 9/1971 | Sanders et al. | 57/87 |
| 4,480,354 | 11/1984 | Glock et al. | 19/244 X |
| 4,484,376 | 11/1984 | Glock et al. | 57/87 X |
| 4,519,199 | 5/1985 | Barauke | 57/87 |
| 4,538,328 | 9/1985 | Stahlecker | 19/288 X |
| 4,538,329 | 9/1985 | Sakai et al. | 19/244 |

*Primary Examiner*—Louis K. Rimrodt
*Assistant Examiner*—J. L. Olds
*Attorney, Agent, or Firm*—Karl F. Ross; Herbert Dubno

[57] ABSTRACT

In order to make possible automatic restart of a spinning machine drafting frame after strand breakage in an easy way, a movable blocking member is insertable between the drive roller of the lower feed belt and the lower feed belt in the direction of the line of contact of the lower feed belt and the drive roller, this blocking member on engagement raising the lower belt from its drive roller by operation of a connecting rod attached pivotally to the detent member. Additional roller pairs present upstream of the feed belts are preferably provided with means for simultaneously lifting the various upper rollers from the lower rollers with or without holding the yarn or thread fixed on engagement of the detent member.

10 Claims, 5 Drawing Figures

SPINNING MACHINE DRAFTING FRAME

FIELD OF THE INVENTION

The present invention relates to a spinning machine drafting frame and more particularly, a drafting frame having at least two contacting feed belts in a main drafting zone through which the roving or slubbing is fed, these belts being guided around at least one guide member or guide roller and being driven by at least one drive roller around which one of the feed belts passes.

BACKGROUND OF THE INVENTION

A spinning machine drafting frame can comprise at least three pairs of rollers through which the yarn or thread is fed during operation, an upper and a lower input roller, a lower driver roller and an upper guiding roller, and an upper and lower supply roller. The various lower rollers are mounted on drive shafts supported rotatably in the spinning machine frame. Advantageously the various upper rollers can be mounted rotatably in a portion of the frame which pivots upward so that fragments of slubbing or roving may be easily removed after a strand breaks.

In the version of the spinning machine drafting frame with which the invention is concerned, two contacting feed belts are, respectively, guided around the lower drive roller and associated guide members, and around an upper guide roller and its associated guide members. Specifically the lower feed belt may pass around the lower drive roller which moves both belts. The slubbing is then fed between these feed belts during operation for the action in the main drafting zone.

In this kind of spinning machine drafting frame the slubbing or roving can be supplied to the drafting frame after a halt due to strand breakage by lifting the various upper rollers from the various lower rollers, while then bringing the slubbing or roving in close contact with a pair of rollers or into an individual roller pair. On restart of the drafting frame the slubbing or roving is supplied manually to the drafting frame of the prior art so that it can be gripped by the appropriate transporting members. Automatic restart without manual reengagement is often difficult to accomplish, because the slubbing or roving ends may be found too far back in the drafting frame or are not held in place for restart after the belts have stopped or while the belts are stopped.

OBJECTS OF THE INVENTION

It is an object of my present invention to provide an improved spinning machine drafting frame whereby disadvantages of prior art machines are obviated.

It is also an object of this invention to provide the structure in a drafting mechanism for a spinning frame necessary for automatic restart of the rolling mill after stoppages due to strand breakage and the like or for other reasons.

It is yet another object of this invention to facilitate threading of a drafting frame and, in general, to improve the operation thereof.

SUMMARY OF THE INVENTION

These objects and others which will become apparent hereinafter are attained in accordance with the invention in a drafting mechanism for a spinning frame having at least two mutually contacting feed belts in the main drawing zone between which the roving or slubbing is fed, these belts being each guided around at least one guide member or guide roller and being driven by at least one of these rollers around which one of the feed belts passes.

Usually one of these feed belts passes around the drive roller which is mounted on a drive shaft held rotatably in an apparatus frame so that, when the drive roller is driven, both the belts are moved thus feeding the strand between these feed belts. Optionally other pairs of rollers may be provided, for example, input rollers through which yarn or thread is fed to the feed input rollers through which yarn or thread is fed to the feed belts and output rollers downstream from the feed belts for delivering the draft strand to the spinning elements of the machine.

According to the invention a movable contact-blocking member is positioned or inserted (interposed) between the drive roller of the lower feed belt and the lower feed belt in the direction of the line of contact of the roller pair associated with the belts.

The movable contact-blocking member can thus raise the lower belt from its drive roller.

Thus the slubbing or roving can be held fixed between the lower feed belt and the upper feed belt, while the subsequent supply or delivery rollers run on. They cause a roving or slubbing break between the belt pair in the main drawing zone and the supply rollers, so that the slubbing or roving ends are found at an easy accessible position comparatively forward in the spinning machine drafting frame. Thus after elimination of a broken strand the slubbing or roving will be automatically again run through the drafting frame.

According to a further feature of the invention, a shifting member for raising the upper roller from the lower roller after strand breakage is provided between the input roller pair, and any additional roller pairs, if required, as was done for the lower belt and the lower belt drive roller. This particular feature is particularly relevant to a four roller pair drafting frame in which an additional roller pair is present between the main drafting zone and the input rollers, but also applies to a spinning machine drafting frame having only one pair of input rollers as well as the two contacting feed belts and their associated drive rollers.

According to another embodiment of the invention the shifting member which raises one of the upper rollers from its associated lower roller after strand breakage is constructed as a slubbing or roving stopping member which holds the slubbing or roving fixed against the upper roller. This slubbing or roving clamping takes place then not only in the main drafting zone, but additionally also in the upstream zone or rather at every roller pair ahead of the main drafting zone (except of course for the supply rollers).

However, the slubbing or roving is not prevented from further travel on restart, but is held fixed simultaneously with clamping of the slubbing against the upper belt. Also the restart of the roller engagement with the slubbing is effected simultaneously with the restoration of contact of the lower belt with its drive motor so that incorrect warping is then impossible.

Advantageously in a preferred embodiment of this invention the detent member and the shifting member or rather the slubbing or roving stopping member has the same general structure and these members may be ganged for simultaneous or synchronized movement. A structure which halts and at other times releases the slubbing or roving according to its relative position is used. An example of such a structure is described below wherein the contact-blocking roving-stopping member is a cylindrical half-shell attached to an operating lever which is pivotally connected to a connecting rod of an operating apparatus. It is particularly advantageous to taper the leading edge of the half-shell which slides between the rollers or between the lower belt and the drive roller.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
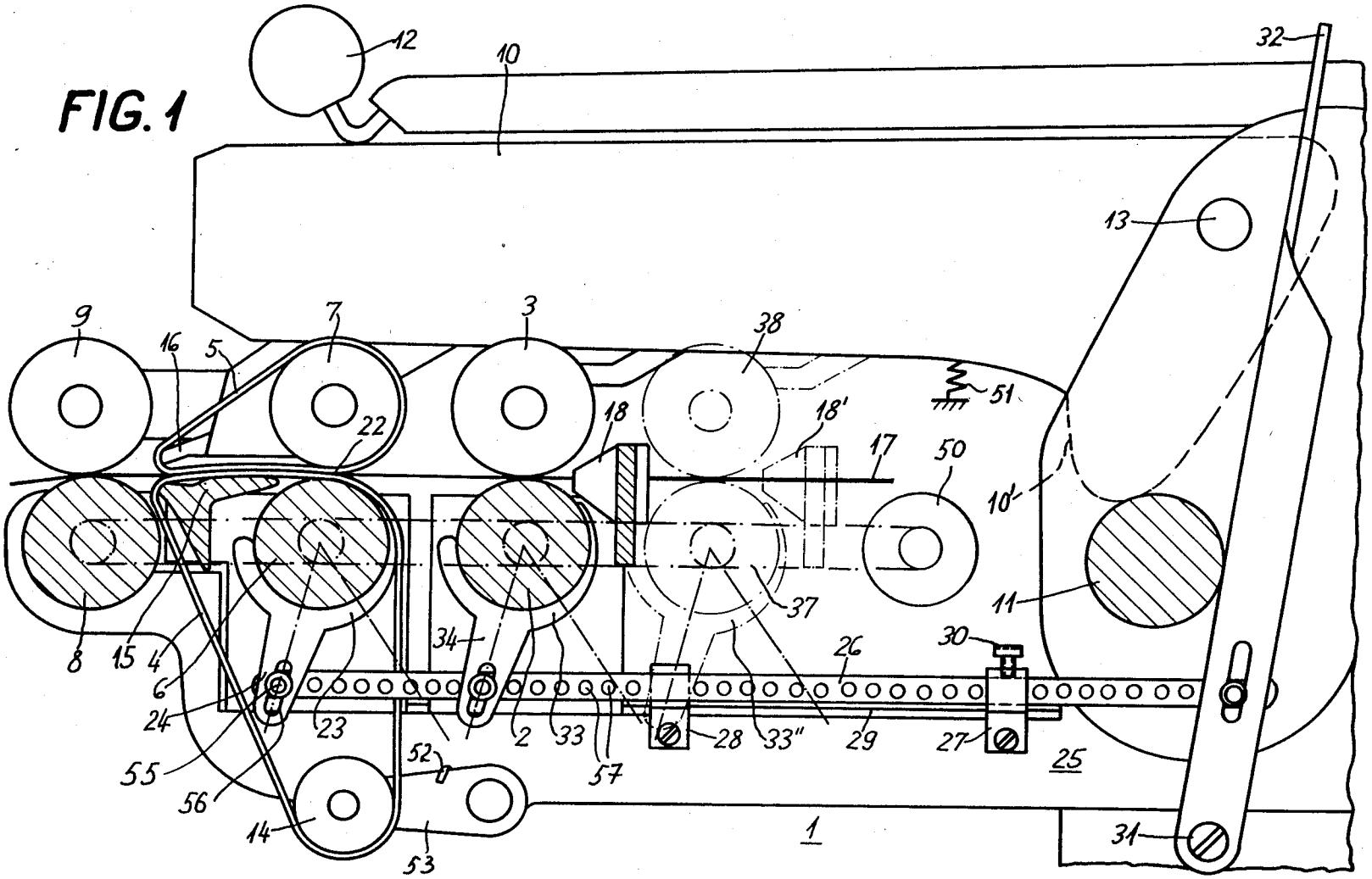
FIG. 1 is a schematic side view of the spinning machine drafting frame, partly broken away and with a removable pair of rollers shown in dot-dash lines.
Figure 2:
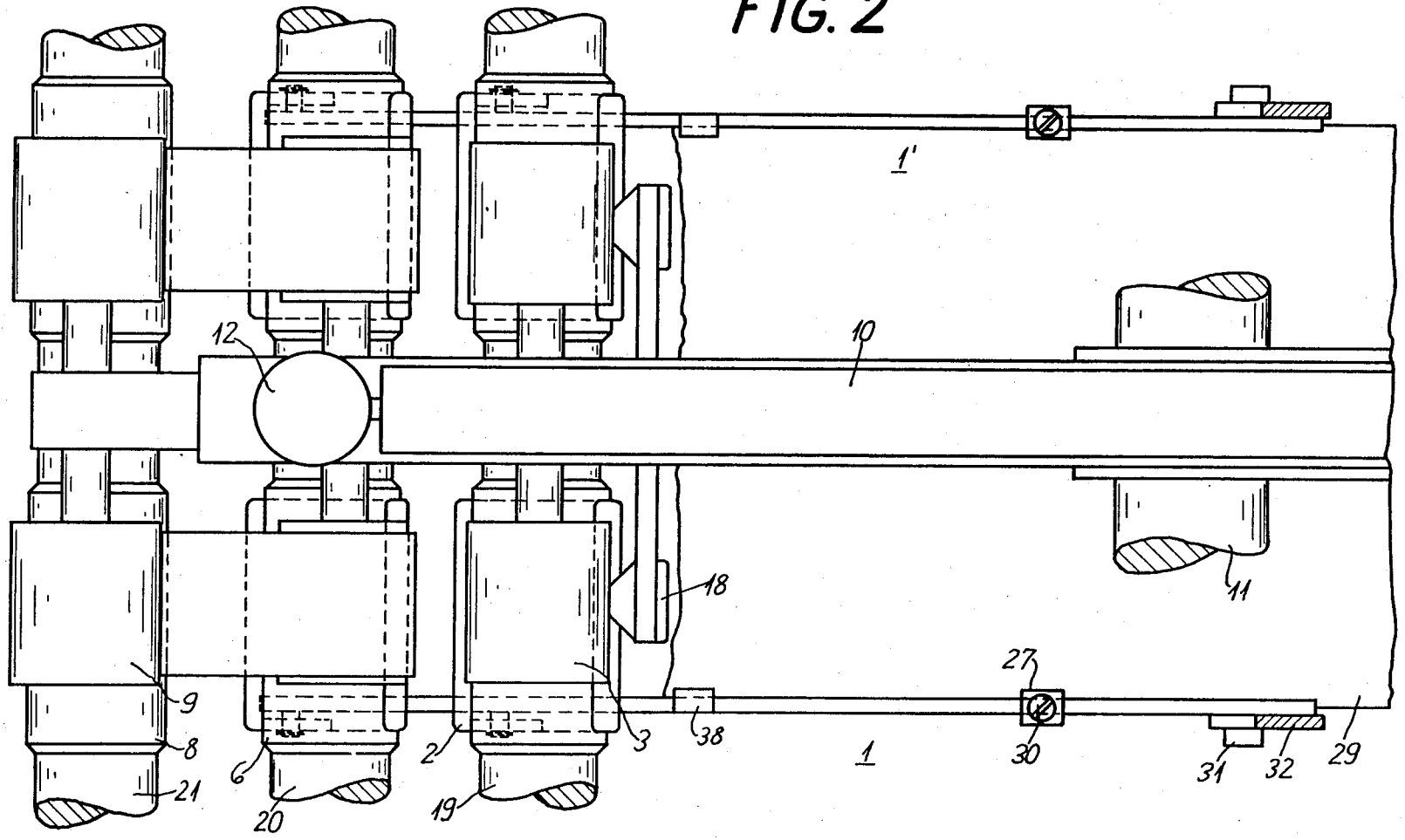
FIG. 2 is a top view of the spinning machine drafting frame of FIG. 1 showing two drafting assemblies side by side with one another and representing a multiplicity of said units in side by side relation.
Figure 3:
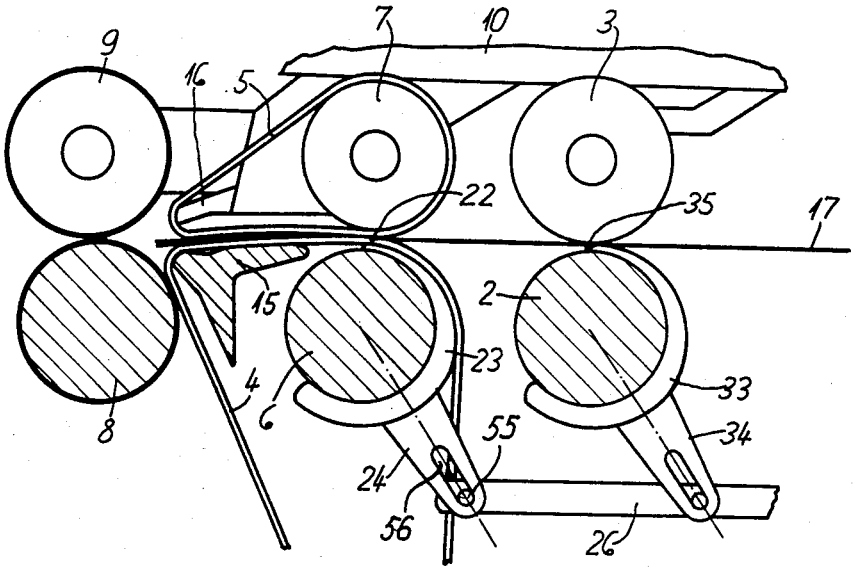
FIG. 3 is a fragmentary side view also partly in section showing a pair of the apparatus of FIG. 1 and, of course, after the halting of the feed of the yarn or thread.

The spinning machine drafting frame 1 shown in FIGS. 1–3 comprises a pair of input rollers, including a lower input roller 2 and an upper input roller 3. Two contacting feed belts are provided in the main drafting zone, that is, a lower feed belt 4 and an upper feed belt 5. The lower feed belt 4 is operated by a lower feed belt drive roller 6 and the upper feed belt 5 is guided about and runs on the upper main roller 7. A pair of supply rollers, comprising a lower roller 8 and an upper roller 9 are also provided.

The various lower rollers 2, 6, and 8 particularly serve as drive roller, i.e. are provided with a continuously operable drive 50, continue to rotate even when the spinning arrangement associated with the drafting frame fails on account of yarn breakage. The various upper rollers 3, 7 and 9 are held rotatably in a support 10 spring biased downwardly as schematically represented at 51. The load of the support 10 rests on a support rod 11 and the support 10 can be swung up by means of a handle 12, which rotates support 10 around its axis of rotation 13.

The lower feed belt 4 is guided and held taut by a tightening roller 14 biased by a torsion spring 52 engaging its lever 53 and by a belt guide 15. The upper feed belt 5 is guided about a belt guide 16.

The yarn or thread up front at the drafting frames entrance or rather the slubbing or the roving 17 is fed through the guide funnel 18 between the input rollers 2 and 3.

It then is fed between the feed belts 4 and 5 and then between the supply or delivering rollers 8 and 9. From there the highly drawn yarn 17 is supplied to the spinning elements of the spinning machine.

FIG. 2 shows that a second drafting line 1' is positioned adjacent the first mentioned line and is controlled by the same handle 12.

The support 10 is thus used with both drafting lines 1 and 1'. Since the drafting line 1' has the same individual components as drafting frame 1 no further description of the second line is required.

FIG. 2 shows also, that the various lower rollers 2, 6, and 8 along the rolling mill have drive shafts 19, 20, and 21 going through them, which are rotatably supported with clearance from each other in the frame of the drafting frame.

Between the drive roller 6 of the lower feed belt 4 and the lower feed belt 4 a blocking member 23 is movable in the direction of the line of contact 22 of the lower feed belt 4 and the drive roller 6, so that in operation, when engaged, raises the lower belt 4 from its drive roller 6 and stops it, as is particularly clearly shown in FIG. 3.

The blocking member 23 comprises a generally cylindrical half-shell whose cross-section is tapered to an edge which engages between the feed belt 4 and the drive roller 6 and an operating lever 24. The half-shell is composed of a resilient, selflubricating plastic material, for example, a plastic such as Delrin (tradename), and is shaped so as to clip on to the lower roller 6, i.e. extends beyond 180° so that it can rotate about the axis of the roller 6 which it hugs.

Blocking member 23 has an operating lever 24, which is connected pivotally to an operating apparatus by a pin 55 movable in slot 56, the actuating apparatus being represented as a whole at 25.

The operating apparatus 25 has a connecting rod 26, which is guided in aligning guides 27 and 28.

The aligning guide 27 has a set screw 30 which is a restraint for the connecting rod 26 and which can lock it against inadvertent movement.

Figure 4:
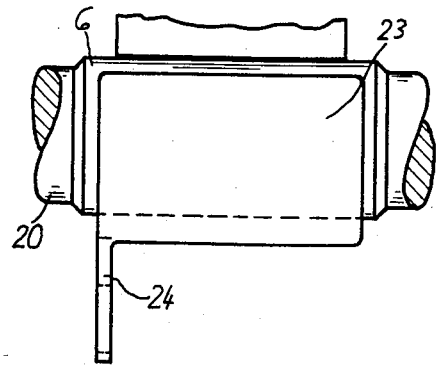
FIG. 4 and FIG. 5 are fragmentary elevational views of the member interposed between the belt and its drive motor and a similarly shaped member for separating two rollers directly according to the invention.

The connecting rod 26 is at its other end not attached to operating lever 24 is pivotally connected with an operating lever 32 rotatable about the pivot 31. The operating lever 32 can be operated either manually or by an unshown movable spinning machine mechanism or also by an activating device which reacts to strand breakage. A side view of the blocking member 23 is shown in FIG. 4.

The lower input roller 2 is embraced by a shifting member 33 for lifting the upper input roller 3 from the lower input roller 2 after thread or strand breaking. This shifting member 33 serves at the same time as a roving stopping member 33 and is constructed exactly like the previously described blocking member 23. Furthermore, the shifting member 33 has an operating lever 34, which is connected pivotally with the connecting rod 26. The distance between the pivot points along the connecting rod 26 is adjustable, e.g. by means of holes 57, or in any other convenient way.

FIG. 3 shows that, after the operating of operating lever 32 and the connecting rod 26, the blocking member 23 with its tapered edge slides between the lower roller 6 and the lower belt 4 until it lies under the line of contact 22; therefore the lower belt 4 is decoupled from the drive roller 6 and stops. Also then the upper belt 5 comes to a stop and the roving 17 remains clamped between the belts along the line of contact 22.

At the same time the tapered edge of the shifting member or rather the roving stopping member 33 slides under the roving 17 under the line of contact 35 between the lower input roller 2 and the upper input roller 3, whereby the upper input roller 3 stops and the slubbing or roving 17 will be also held fast along the line of contact 35. The pair of supply rollers 8 and 9 rotate against the yarn 17 further, whereby a roving or slubbing break occurs so that the new slubbing or roving end will be found between the belts 4 and 5.

Figure 5:
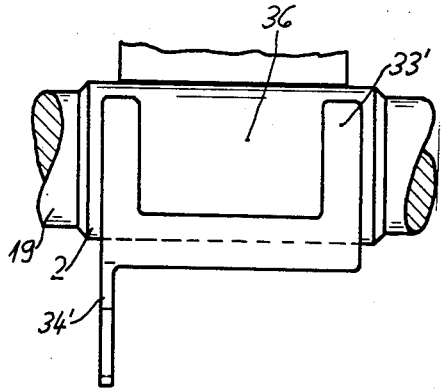

An alternative structure 33' for the shifting member for raising the upper input roller 3 from the lower input roller 2 is shown in FIG. 5. The shifting member 33' is basically of the same construction as the blocking member 23 or the slubbing or roving stopping member 33 with the distinction that a large opening is present in the tapered free end of the shell, so that in the raising of the upper roller 3 the front yarn or rather the slubbing or roving 17 can not be clamped with the shifting member 33 although the fingers flanking this window are effectively interposed between the rollers 2 and 5.

As can also be seen from FIG. 1 the additional pair of rollers comprising lower roller 37 and upper roller 38 which are shown by dot-dash lines can be removed. Naturally when the additional pair of rollers is present, the lower roller 37 is provided with a respective shifting member 33'' similar to the shifting members 33 and 33'. Furthermore, the feeding funnel 18' in this case is positioned as shown in FIG. 1.

My invention's limits and bounds are set forth in the claims appended hereto and should not be construed any more narrowly because of any particular details or individual structures set forth by the foregoing specific description.

I claim:

1. In a spinning machine drafting frame having at least two contacting feed belts in a main drafting zone through which the yarn or thread is fed, said belts being each guided around at least one guide member and at least one roller, one of said rollers being a drive roller, the improvement wherein between said drive roller and the respective one of said belts a movable blocking member is insertable in the direction of the line of contact of said drive roller and said one belt, said blocking member on engagement raising said one belt from said drive roller of said one belt and thereby stopping both said belts, said spinning machine drafting frame having at least one pair of rollers through which yarn or thread is fed between said feed belts, said roller pair comprising an upper roller contacting a lower roller, and said upper roller being mounted rotatably on a support which is raisable so that said upper roller may be raised from said lower roller, a shifting member for raising said upper roller from said lower roller being provided, said blocking member being constructed as a part cylindrical shell, conformed to engage said drive roller and pivotally attached to an operating lever engaged to a connecting rod of an operating apparatus, said pair cylindrical shell being insertable between said drive roller of said lower feed belt and said lower feed belt, when said connecting rod is pulled away from said blocking member so as to pivot said blocking member between said drive roller and the respective feed belt.

2. The improvement defined in claim 1 wherein an edge of said shell between said lower belt and said drive roller is tapered.

3. A spinning machine drafting frame comprising:

an upper and lower input roller rotatably mounted for receiving and holding yarn or thread;

an upper and lower contacting feed belt positioned immediately downstream of said input rollers so as to receive yarn or thread from said input rollers, said lower feed belt being circulated about a drive roller which acts to move both upper and lower feed belts and said upper feed belt being circulated about a main upper guide roller;

an upper and lower supply roller positioned downstream of said belts so as to receive thread or yarn from said belts; said lower rollers being attached to drive shafts for driving said rollers mounted rotatably in said frame of said spinning machine drafting frames, and said upper rollers being mounted rotatably in a pivotable support so as to be able to be raised from said lower rollers;

a movable blocking member comprising a first shell attached to a first operating lever, said first operating lever being pivotally connected to a connecting rod of an actuator, and a movable shifting member comprising a second shell attached to a second operating lever pivotally connected to said connecting rod, said first shell of said blocking member being slidable between said lower belt and said drive roller when said blocking member is engaged by pulling said connecting rod so as to raise said lower belt from said drive roller and thus stop said belts while simultaneously said second shell of said shifting member slides between said upper and lower input rollers so as to raise said upper input roller from said lower input roller.

4. A drafting frame comprising:

a base;

a support arm overhanging said base and pivotally mounted thereon to enable said arm to swing away from said base;

an upper delivery roller journaled on said arm and a lower delivery roller journaled on said base to form a pair of delivery rollers through a nip of which drafted slubbing is fed to a spinning machines;

an upper input roller journaled on said arm and a lower input roller journaled on said base to form a pair of input rollers through a nip of which slubbing is fed to a main drafting zone for drafting before it enters said pair of delivery rollers;

an upper guide roller journaled on said arm in said zone and a lower guide roller journaled on said base in said zone, and respective belts passing around said guide rollers and contacting each other along a contact line between said guide rollers;

drive means for driving simultaneously all of said lower rollers;

a blocking member selectively interposable between said lower guide roller and the respective belt for clamping slubbing between said belts and immobilizing same while said lower rollers continue to rotate;

a further member selectively interposable between said lower input roller and said upper input roller for separating same; and a common actuator connected to both said members for simultaneously displacing same, each of said members being a part cylindrical shell embracing a respective one of said rollers and having a respective lever attached thereto, said actuator being a rod pivotally connected to said levers.

5. A drafting frame for a spinning machine, comprising:

a lower input roller and an upper input roller having a nip receiving a roving to be drawn in said frame;

a lower belt roller and an upper belt roller juxtaposed with one another and spaced from said input rollers in a direction of displacement of said roving;

a lower feed belt passing over said lower belt roller and a belt guide downstream of said lower belt roller in said direction, and an upper feed belt passing over said upper belt roller and a belt guide downstream of said upper belt roller in said direction whereby said feed belts receive said roving from said input rollers and normally bear upon said roving from above and below;

a lower supply roller and an upper supply roller having a nip receiving said roving from between said feed belts and located downstream of said belts and said belt guides in said direction;

means for driving said lower rollers and thereby entraining said belts into rotation; and a movable blocking member insertable between said lower belt roller and said lower feed belt for lifting said lower feed belt from said lower belt roller while pressing said lower feed belt against said upper feed belt and thereby immobilizing both said belts and said roving while clamping said roving between said belts as said lower belt and supply rollers continue to rotate.

6. The drafting frame defined in claim 5 wherein said blocking member is a part cylindrical shell conformed to and partly surrounding said lower belt roller and pivotally attached to an operating lever displaceable to insert said shell between said lower belt roller and said lower feed belt.

7. The drafting frame defined in claim 6 wherein all of said upper rollers are mounted upon a downwardly loaded support, further comprising a movable shifting member displaceable conjointly with said blocking member and insertable between said lower input roller and said upper input roller for lifting said upper input roller away from said lower input roller.

8. The drafting frame defined in claim 7 wherein said shifting member is a part cylindrical shell conformed to and partly surrounding said lower input roller and pivotally attached to an operating lever displaceable to insert said shell of said shifting member between said lower input roller and said upper input roller.

9. The drafting frame defined in claim 8 wherein said shifting member is constructed and arranged to clamp said roving when said shifting member is displaced between said input rollers.

10. The drafting frame defined in claim 8 wherein said shifting member is constructed and arranged to clear said roving when said shifting member is displaced between said input rollers.

* * * * *